United States Patent [19]

Eizen

[11] Patent Number: 4,856,309

[45] Date of Patent: Aug. 15, 1989

[54] PIN TUMBLER LOCK

[75] Inventor: Noach Eizen, Rishon Lezion, Israel

[73] Assignee: Mul-T-Lock, Ltd., Yavneh, Israel

[21] Appl. No.: 98,596

[22] Filed: Sep. 16, 1987

[30] Foreign Application Priority Data

Jul. 3, 1987 [IL] Israel ..... 83071

[51] Int. Cl.[4] ..... E05B 27/04

[52] U.S. Cl. ..... 70/359; 70/375; 70/378; 70/419; 70/493

[58] Field of Search ..... 70/357, 359, 362-364 A, 70/375, 378, 419

[56] References Cited

U.S. PATENT DOCUMENTS

| | | | |
|---|---|---|---|
| 1,739,964 | 12/1929 | Hainline | 70/364 A X |
| 2,043,205 | 6/1936 | Thompson | 70/364 A |
| 2,194,469 | 3/1940 | Fremon | 70/364 A |
| 2,281,714 | 5/1942 | Rauh | 70/364 A |
| 2,283,489 | 5/1942 | Crousore | 70/364 A X |
| 2,565,531 | 8/1951 | Spiegler | 70/364 A |
| 2,596,720 | 5/1952 | Pastor et al. | 70/364 A |
| 2,629,249 | 2/1953 | Mendelsohn | 70/364 A X |
| 3,393,542 | 7/1968 | Crepinsek | 70/378 X |
| 3,731,507 | 5/1973 | Wolter | 70/358 |
| 3,824,818 | 7/1974 | Neale | 70/358 |
| 4,068,508 | 1/1978 | Genakis | 70/364 A |
| 4,068,509 | 1/1978 | Genakis | 70/364 A |
| 4,098,103 | 7/1978 | Raskevicius | 70/375 X |
| 4,107,966 | 8/1978 | Schlage | 70/375 X |
| 4,142,389 | 3/1979 | Bahry et al. | 70/359 |
| 4,151,731 | 5/1979 | Tucker | 70/364 A |
| 4,577,479 | 3/1986 | Widen | 70/364 A |
| 4,631,942 | 12/1986 | Sierra | 70/375 X |
| 4,655,063 | 4/1987 | Foshee et al. | 70/364 A X |

FOREIGN PATENT DOCUMENTS

| | | |
|---|---|---|
| 2250605 | 5/1973 | Fed. Rep. of Germany . |
| 3003369 | 9/1980 | Fed. Rep. of Germany . |

*Primary Examiner*—Gary L. Smith
*Assistant Examiner*—Suzanne L. Dino

[57] ABSTRACT

A pin tumbler lock comprises a cylindrical shell, a plug fitted within the shell, and rotatable by key means. The plug has first bores for receiving first pin tumblers. The first bores are substantially normal to the axis of the plug. The shell has second bores for receiving second pin tumblers therein. The second bores are aligned with first bore. First and second pin tumblers are located in bores. The second pin tumblers are forced by a spring into the aligned first bores to thereby prevent rotation of the plug. The first and second pin tumblers have substantially mating surfaces at respective ends providing contact along their entire length. The plug includes two grooves in a plane normal to the axis of the plug along its periphery, one groove on each side adjacent to first bores, thereby providing a non-linear shear line between the plug and the shell.

8 Claims, 2 Drawing Sheets

PIN TUMBLER LOCK

BACKGROUND OF THE INVENTION

The present invention concerns a pin tumbler cylinder lock which is more resistant to picking than the cylinder locks of this type known heretofore.

Cylinder locks generally comprise a number of pin tumblers spring loaded within bores which must be depressed by the proper projections in the key in order for the plug of the lock to be rotated within the shield.

The bores in the plug and shell, due to manufacturing limitations, always vary in diameter. In cylinder locks the holes are drilled. The tool for drill bits doing the work is quite long in relation to its diameter. Also because of the flexibility of the drill and uneven consistencies in the metal being drilled, and because they are not perfectly formed at the cutting edges, these drills usually drill holes of varying diameters. Drills will also run off of a true center line. These manufacturing limitations cause the whole inner plug and shell never to be matching exactly, even in the most expensive and well made locks. Because of these manufacturing deficiencies, lock picking is made easier because once the end of the pin tumbler is aligned with the shear line, a shim can be introduced to maintain the separation of plug tumbler pins and shell tumbler pins. As the next pair of tumbler pins are picked, the shim can be advanced linearly to continue and maintain the separation between the plug tumblers and shell tumblers, and so on until all of the tumblers are separated along the shear line with the shim maintaining this separation.

Locks of this type can also be picked without the use of a shim as follows. Once the end of the pin tumbler is aligned with the shear line, its position can be held by applying a slight turning pressure on the plug. As the next pair of tumbler pins is picked, slight further twisting of the plug maintains the ends of the second pin tumblers aligned with the shear line, and so on until all the tumblers are separated at the shear line and the plug can be rotated in the shell. This is made possible by the loose fit of the pin tumblers in the bores and by the non-mating surfaces of core and shell pin tumblers which is a direct result of having a linear shear line.

This problem is more acute with dual pin tumbler locks, since the bores and pin tumblers in such locks are of a larger diameter than in single pin tumbler locks. Such a dual pin tumbler lock was disclosed in our Pat. No. 50,984.

SUMMARY OF THE INVENTION

It is the object of the present invention to provide a cylinder lock with a plug and pin tumblers that will make it more difficult to pick.

The invention present consists in a pin tumbler lock comprising a shell, a plug within said shell, said plug rotatable by key means, the plug having first bore means for receiving first pin tumblers, the first bore means being substantially normal to the axis of the plug, the shell having second bore means for receiving second pin tumblers therein, the second bore means being aligned with the first bore means, first pin tumblers in the first bore means, second pin tumblers in the second bore means, and means in the shell for forcing the second pin tumblers into the aligned first bores to thereby prevent rotation of the plug, characterized in that first and second pin tumblers have substantially mating surfaces at their points of contact and that the plug comprises two grooves normal to the axis of the plug, one groove on each side adjacent the first bore means, thereby providing a non-linear shear line between the plug and the shell.

The present invention is illustrated, by way of example only, in the accompanying drawings in which:

DETAILED DESCRIPTION OF THE PREFERRED EMBODIMENT(S).

Figure 2:
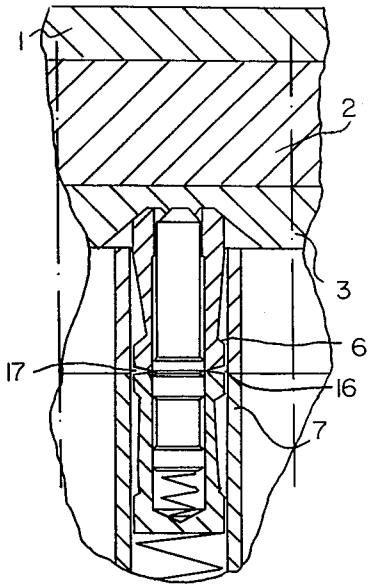
FIG. 2 PRIOR ART
FIG. 2 is a sectional view of the longitudinal cross-section of the prior art cylinder lock of FIG. 1.
Figure 1:
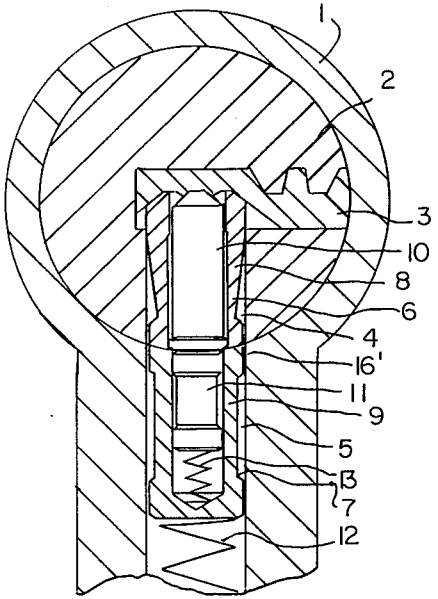
FIG. 1 PRIOR ART
FIG. 1 is a vertical section of a prior art cylinder lock.

With reference to FIGS. 1 and 2, these locks comprise a shell 1 in which a plug 2 is rotatable by means of a key 3 as known in the art. The plug 2 is provided with a bore 4, and the shell 1 with bore 5, each of these bores housing tumbler pins 6 and 7 respectively. In the present illustration the tumbler pins are constituted by two parts, i.e. tumbler pin 6 in the core comprised of an outer cylindrical part 8 and an inner part 10, and tumbler 7 in the shell comprised of an outer cylindrical part 9 and an inner part 11. The outer and inner pins 9 and 11 are urged by means of springs 12 and 13 respectively. Thus the inner pins 10 of the core and 11 of the shell can move telescopically within their respective outer cylindrical parts 8 and 9.

Figure 5:
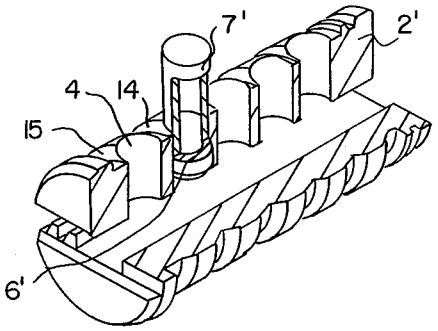
FIG. 5 is an enlarged isometric cutout view of a plug and pin tumbler according to the invention.
Figure 4:
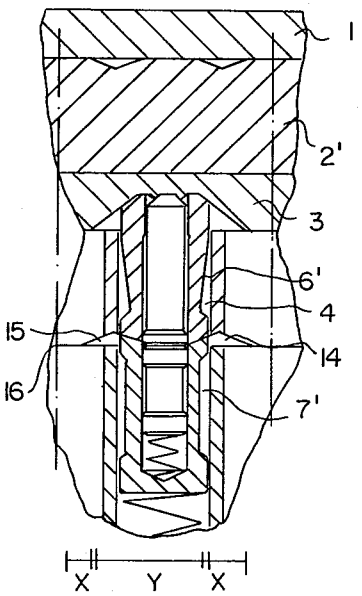
FIG. 4 is a sectional view of the longitudinal cross-section of the cylinder lock according to the invention.
Figure 3:
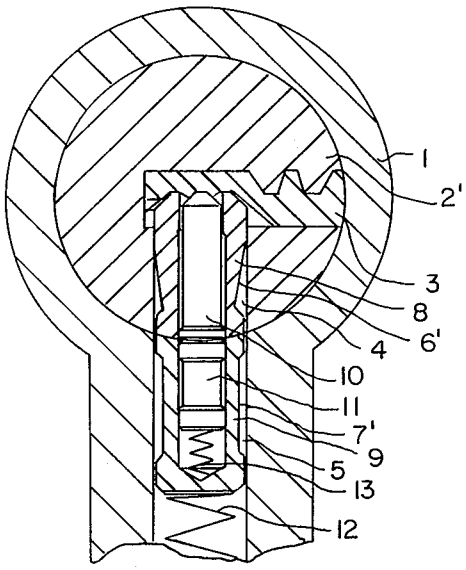
FIG. 3 is a vertical section view of the cylinder lock of the invention.

Referring now to FIGS. 3-5 which illustrate the invention, the plug 2' comprises grooves, 14 and 15, adjacent bore 4 of plug 2'. This enables tumbler 6' in the plug 2' to mate its counterpart tumbler pin 7' in shell 1, so that along their entire contact surface tumblers 6' and 7' are closely engaged. The shear line 16 is therefore not linear, but rather wavy, some parts being linear along x (FIG. 2) and others being curved along y. This creates much less freedom of movement for the tumblers around the shear line and requires more accurate matching of the tumblers before the plugs will rotate within the shell.

FIG. 5 shows on an enlarged scale the grooves 14 and 15 in plug 2' and the mating pin tumblers 6' and 74'.

In the prior art locks shown in FIGS. 1 and 2, the plug which is cylindrical in shape comprised a smooth linear outer circumference. When such a plug is inserted into a shell, there is formed a linear shear line 16' between the plug 2 and shell 1. The outer tumblers 6 and 7 are not mated at their point of contact and a space 17 inherently exists between the core and shell pin tumblers.

It is of course understood that the present invention is also applicable to single pin tumbler locks and not only to dual pin tumbler locks as exemplified.

The grooves on each side of the bore, as required by this invention, can be in respect of a single bore or in respect of all the bores of the plug.

I claim:

1. A pin tumbler lock comprising a shell with a cylindrical hole, a cylindrical plug fitting within said hole of said shell, said plug being rotatable by key means, said plug having first bore means for receiving first pin tumblers, said first bore means being substantially normal to the axis of said plug, said shell having second bore means for receiving second pin tumblers therein, said second bore means being aligned with said first bore means, first pin tumblers in said first bore means, second pin tumblers in said second bore means, and means in said shell for forcing said second pin tumblers into said aligned first bores to thereby prevent rotation of said plug, said first and second pin tumblers having at the respective ends contacting each other substantially mating surfaces to provide contact substantially along entire surface of the contacting ends, said plug comprising two substantially parallel grooves each extending in a plane normal to the axis of said plug and along the periphery of said plug, one of said grooves being provided on each opposite side of said first bore means, along the longitudinal axis of said plug and adjacent said first bore means, and said first and second tumbler pins being rotatable independently of one another and mating at least partially within said grooves in said plug, thereby providing a non-linear shear line between said plug and said shell irrespective of the circumferential position of said pins, said bore means and said plug.

2. A pin tumbler lock according to claim 1 wherein said mating surfaces include a convex surface on said first pin tumbler and a corresponding concave surface on said second pin tumbler.

3. A pin tumbler lock according to claim 1 wherein the lock is a dual pin tumbler lock including telescopic pin tumblers independent of one another located in a telescopic arrangement.

4. A pin tumbler lock according to claim 2 wherein the lock is a dual pin tumbler lock including telescopic pin tumblers independent of one another located in a telescopic arrangement.

5. A pin tumbler lock according to claim 1 wherein said means in said shell for forcing said second pin tumblers into said first bore means comprises spring means.

6. A pin tumbler lock according to claim 2 wherein said means in said shell for forcing said second pin tumblers into said first bore means comprises spring means.

7. A pin tumbler lock according to claim 1 wherein said bore means includes plurality of bores in said plug with said grooves being provided adjacent both opposite sides of each of said bores along the axis of said plug.

8. A pin tumbler lock according to claim 2 wherein said bore means includes plurality of bores in said plug with said grooves being provided adjacent both opposite sides of each of said bores along the axis of said plug.

* * * * *